United States Patent [19]

Murasaki et al.

[11] Patent Number: 4,851,872

[45] Date of Patent: Jul. 25, 1989

[54] DEVELOPING DEVICE WITH DEVELOPER SLEEVE FACILITATING DEVELOPER SUPPLY ADJUSTMENT BY BRISTLE HEIGHT REGULATING MEMBER

[75] Inventors: Hiroshi Murasaki, Ibaragi; Hiroshi Mizuno, Ikoma; Akihito Ikegawa, Sakai; Kouichi Etou, Takatsuki, all of Japan

[73] Assignee: Minolta Camera Kabushiki Kaisha, Osaka, Japan

[21] Appl. No.: 49,144

[22] Filed: May 13, 1987

[30] Foreign Application Priority Data

May 15, 1986 [JP] Japan ..... 61-111972

[51] Int. Cl.[4] ..... G03G 15/09

[52] U.S. Cl. ..... 355/253; 118/658

[58] Field of Search ..... 355/3 DD, 14 D; 118/658; 430/122

[56] References Cited

U.S. PATENT DOCUMENTS 4,615,606 10/1986 Nishikawa ..... 355/3 DD 4,653,427 3/1987 Hosaka et al. ..... 430/122 X

FOREIGN PATENT DOCUMENTS 61-166571 7/1986 Japan .

*Primary Examiner*—Arthur T. Grimley

*Assistant Examiner*—J. Pendegrass

*Attorney, Agent, or Firm*—Wenderoth, Lind & Ponack

[57] ABSTRACT

A developing device includes a developing sleeve provided rotatably at a side of an electrostatic latent image support member, a supply member for supplying developer to the developing sleeve, a bristle height regulating member which confronts an upper portion of the developing sleeve so as to adjust an amount of the developer transported to a developing region and a plurality of magnets provided in the developing sleeve. The magnetic poles of the magnets not only extend in an axial direction of the developing sleeve but are arranged in a circumferential direction of the developing sleeve. The magnetic poles include a weak magnetic pole disposed adjacent to the upper portion of the developing sleeve and two strong magnetic poles between which the weak magnetic pole is interposed. The strong magnetic poles have a polarity different from that of the weak magnetic pole.

8 Claims, 3 Drawing Sheets

DEVELOPING DEVICE WITH DEVELOPER SLEEVE FACILITATING DEVELOPER SUPPLY ADJUSTMENT BY BRISTLE HEIGHT REGULATING MEMBER

BACKGROUND OF THE INVENTION

The present invention relates to a developing device for use in an image forming apparatus such as a copying apparatus, etc.

Conventionally, developing devices are widely used. In the known developing devices, a developing sleeve is disposed adjacent to an electrostatic latent image support member so as to be driven to rotate and a plurality of magnets are securely provided in the developing sleeve and along an outer peripheral surface of the developing sleeve such that magnetic poles of the magnets extend in an axial direction of the developing sleeve. Thus, developer supplied to the surface of the developing sleeve is magnetically held on the surface of the developing sleeve by the magnets so as to form a magnetic brush on the surface of the developing sleeve. Then, during rotation of the developing sleeve, the above-described magnetic brush rubs against the surface of the electrostatic latent image support member such that the electrostatic latent image is developed into a visible image. In the known developing devices of the above-described type, in order to regulate the amount of the developer transported to a developing region where the developing sleeve and the electrostatic latent image support member confront each other, a bristle height regulating plate is usually provided so as to confront the developing sleeve.

Meanwhile, a prior art developing device employing a two-component developer composed of toner and carrier has a drawback in that since the toner and the carrier are stirred to be mixed with the toner being electrically charged through friction between the toner and the carrier, a stirring member for stirring the developer is required in addition to the developing sleeve.

In response to a recent trend in copying apparatuses towards compactness, there is a high demand for a compact developing device.

Thus, in order to make the developing device compact, the present inventors considered that the developer is stirred on the outer peripheral surface of the developing sleeve. To this end, a method was employed in which the advance of the developer transported on the outer peripheral surface of the developing sleeve is blocked by the above-described bristle height regulating plate such that convection of the developer is caused.

However, a distal end portion of the bristle height regulating member usually confronts a dense portion of the magnetic brush, which is disposed between opposite magnetic poles each having a large magnetic force so as to be inclined towards the outer peripheral surface of the developing sleeve. Therefore, the developer cut off by the bristle height regulating member is pushed by the developer subsequently transported so as to rise along the bristle height regulating member. However, since an attractive force of the strong magnetic poles is larger than the rising force of the developer, the developer cannot rise smoothly along the bristle height regulating member, so that lumps of the developer are formed in front of the bristle height regulating member and thus, in the worst case, clogging of the developer possibly takes place, thereby resulting in a state in which it is impossible to perform development.

Meanwhile, even if the developer rises along the bristle height regulating member, the amount of the developer which has risen along the bristle height regulating member is small and falls in an unmixed state on the surface of the developing sleeve intermittently. Hence, an inconvenience is incurred in which the amount of the developer transported to the developing region becomes nonuniform with the result that the nonuniform density appears on the copied image, thus resulting in an improper image.

Furthermore, since the bristle height regulating member is brought into contact with the magnetic brush in a dense state, resistance between the bristle height regulating member and the magnetic brush is great. As a result, a disadvantage of a large load being applied to a driving source for driving the developing sleeve transporting the developer is present. And, since the amount of the developer transported to the developing region varies greatly according to a slight error in adjustment of a gap between the bristle height regulating member and the developing sleeve, it is troublesome to adjust the gap.

SUMMARY OF THE INVENTION

Accordingly, an essential object of the present invention is to provide a developing device which eliminates the above-described disadvantages inherent in conventional developing devices.

In order to accomplish this object of the present invention, a developing device according to the present invention comprises: a rotatable developing sleeve for developing an electrostatic latent image formed on a support member and provided adjacent to the member; a supply means for supplying developer to said developing sleeve; a bristle height regulating member which confronts an upper portion of said developing sleeve so as to limit an amount of the developer transported to a developing region where said support member and said developing sleeve confront each other; and a plurality of magnets which are provided in said developing sleeve such that magnetic poles of said magnets extend in an axial direction of said developing sleeve; said magnetic poles being arranged in a circumferential direction of said developing sleeve and including a first magnetic pole disposed adjacent to said upper portion of said developing sleeve and second and third magnetic poles between which said first magnetic pole is interposed; said first magnetic pole having a predetermined polarity; said second and third magnetic poles being magnetized to a polarity different from that of said first magnetic pole and each exerting a magnetic force that is larger than that of said first magnetic pole.

BRIEF DESCRIPTION OF THE DRAWINGS

This object and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
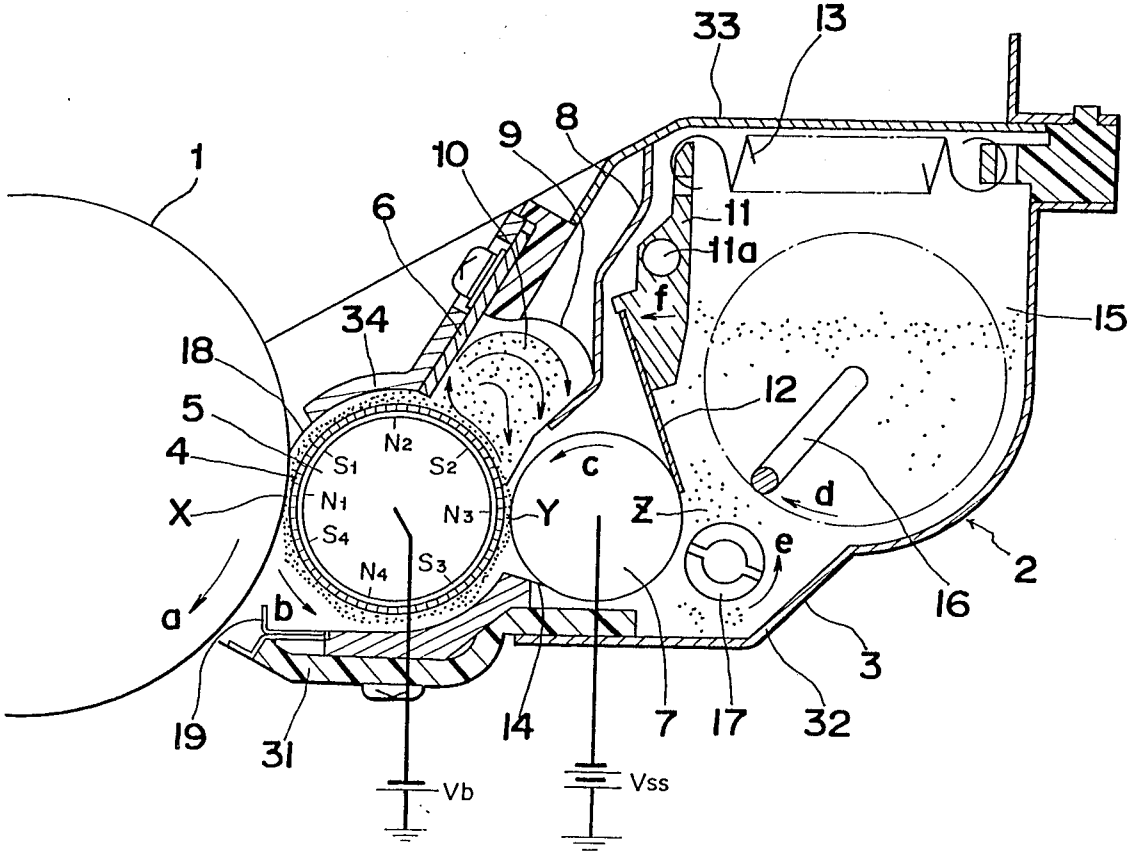
FIG. 1 is a sectional view of a developing device according to one preferred embodiment of the present invention.

Referring now to the drawings, there is shown in FIG. 1, a developing portion of a copying apparatus, which is provided with a developing device 2 according to the present invention. The developing device 2 is disposed at a side of a photosensitive or photoreceptor drum 1. An electrostatic latent image relating to an image to be copied is formed on the surface of the photosensitive drum 1 through corona charging and exposure of the surface of the photosensitive drum 1. The developing device 2 supplies toner to the electrostatic latent image so as to develop the electrostatic latent image into a visible image.

In FIG. 1, the developing device 2 includes a developing sleeve 4 and a toner supply roller 7 which are arranged to the right of the photosensitive drum 1 in the foregoing order in a developing tank 3 consisting of casings 31, 32, 33 and 34. In the developing tank 3, a toner reservoir 15 is defined to the right side of the toner supply roller 7.

The developing sleeve 4 is made of an electrically conductive non-magnetic material such as aluminium and has a cylindrical shape. The developing sleeve 4 has, on its surface, minute uneven portions formed by blasting. A bias voltage Vb is applied to the developing sleeve 4. The developing sleeve 4 is disposed adjacent to the photosensitive drum 1 driven to rotate in the direction of the arrow a and is itself driven to rotate in the counterclockwise direction indicated by arrow b.

A magnetic roller 5 is accommodated in the developing sleeve 4 and is comprised of a plurality of magnets having magnetic poles N1 to N4 and S1 to S4. Each of the magnetic poles N1 to N4 is a N(north)-pole, while each of the magnetic poles S1 to S4 is a S(south)-pole. The magnetic poles N1 to N4 and S1 to S4 extend in an axial direction of the developing sleeve 4 and are arranged in a circumferential direction of the developing sleeve 4 with the N-poles N1 to N4 and the S-poles S1 to S4 alternately disposed in the circumferential direction of the developing sleeve 4. The magnetic roller 5 is secured at the position shown in FIG. 1.

The magnetic pole N1 confronts the photosensitive drum 1 and the magnetic pole N3 is disposed diametrically opposite to the magnetic pole N1 and confronts the toner supply roller 7. The magnetic pole N2 is disposed at an upper portion of the magnetic roller 5 slightly offset in the transport direction (arrow b) of the developer from a portion of the magnetic roller 5 confronting a bristle height regulating plate 6 to be described later.

Figure 2:
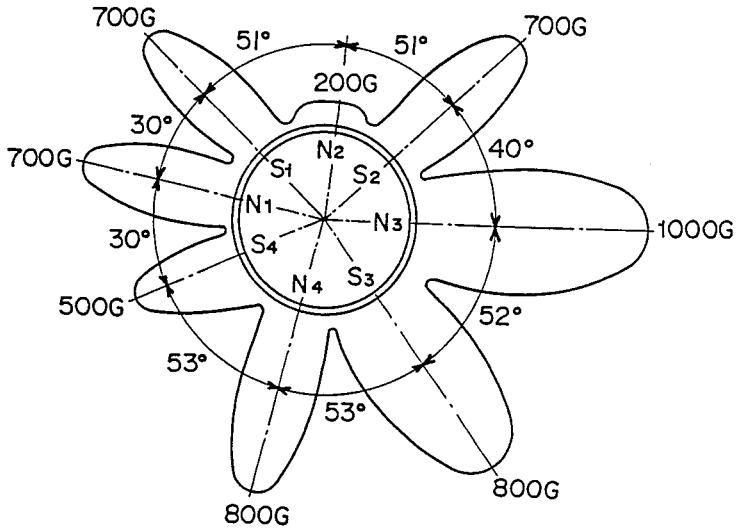
FIG. 2 is an explanatory diagram showing the distribution of magnetic force of a magnetic roller employed in the developing device of FIG. 1.

As will be seen from FIG. 2 illustrating the distribution of magnetic force exerted by the magnetic roller 5, the magnetic poles N1, S1 and S2 each exerting a magnetic force of 700 G (gauss), the magnetic pole N3 exerting a magnetic force of 1,000 G, the magnetic poles S3 and N4 each exerting a magnetic force of 800 G and the magnetic pole S4 exerting a magnetic force of 500 G are strong magnetic poles. Meanwhile, the magnetic pole N2 interposed between the magnetic poles S1 and S2 is a weak magnetic pole exerting a magnetic force of 200 G.

Figure 3:
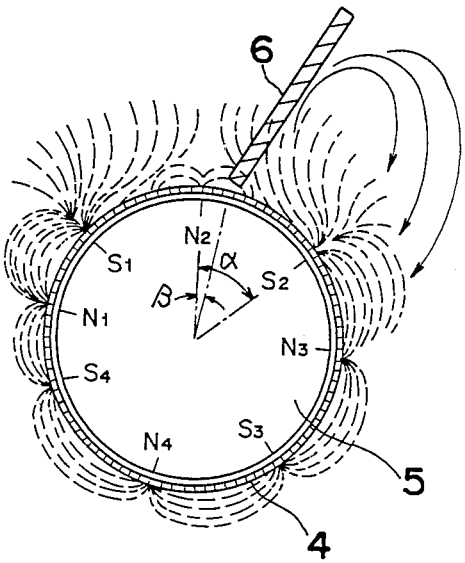
FIG. 3 is an explanatory diagram showing the distribution of lines of magnetic force generated from the magnetic roller of FIG. 2.

Thus, as shown in FIG. 3, lines of magnetic force are generated around the developing sleeve 4 and are distributed in a layered state between neighboring ones of the magnetic poles so as to be directed from a center of one of the neighboring ones of the magnetic poles to a center of the other of the neighboring ones of the magnetic poles. Since the magnetic pole N2 is weak, the lines of magnetic force generated from the magnetic poles S1 and S2 only slightly toward the magnetic pole N2 and thus, almost all the lines of magnetic force generated from the magnetic poles S1 and S2 extend towards the respective neighboring magnetic poles N1 and N3 so as to diverge in a radial direction of the developing sleeve 4 in the vicinity of the weak magnetic pole N2.

The bristle height regulating plate 6 is attached to the casing 34 and is disposed upwardly and to the right of the developing sleeve 4 so as to be inclined rightwards. The bristle height regulating plate 6 confronts the developing sleeve 4 such that a predetermined bristle height regulating gap is defined therebetween. The bristle height regulating plate 6 trims a magnetic brush formed on the surface of the developing sleeve 4 so as to adjust the amount of developer transported to a developing region X where the photosensitive drum 1 and the developing sleeve 4 confront each other.

Meanwhile, a film 18 for preventing scattering of the toner from the developing tank is attached to the casing 34 so as to be disposed above the developing region X, while a plate 19 for receiving the toner falling from the developing sleeve 4 is attached to the casing 31 so as to be disposed below the developing region X.

Figure 4:
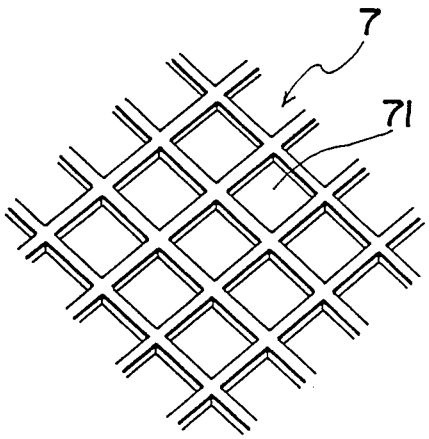
FIG. 4 is an enlarged fragmentary perspective view of a toner supply roller employed in the developing device of FIG. 1.

The toner supply roller 7 is made of an electrically conductive non-magnetic material such as aluminium and is disposed at a side of the developing sleeve 4 remote from the photosensitive drum 1 so as to axially extend in the vicinity of and parallel to the developing sleeve 4. A bias voltage Vss is applied to the toner supply roller 7 and the toner supply roller 7 is driven to rotate in the direction of the arrow c. As shown in FIG. 4, the toner supply roller 7 is formed, on its surface, with a checked pattern defined by minute recesses 71 of 5 to 60 $\mu$m in depth except for mirror surface portions disposed at opposite ends of the toner supply roller 7.

Above the toner supply roller 7, a developer receiving plate 8 is attached to the casing 33 so as to confront the toner supply roller 7. The developer receiving plate 8 is bent at its intermediate portions such that a distal end of the developer receiving plate 8 is disposed above an area where the toner supply roller 7 and the developing sleeve 4 confront each other. Above the area where the toner supply roller 7 and the developing sleeve 4 confront each other, a hollow 10 is defined by the bristle height regulating plate 6, the developer receiving plate 8 and a sheet 9.

Meanwhile, at a side of the toner supply roller 7 remote from the developing sleeve 4 and disposed above the toner supply roller 7, a partition wall 11 is pivotally supported by a support shaft 11*a* so as to be pivoted about the support shaft 11*a*. A tension spring 13, is attached, at one end, to an upper rear end portion of the developing tank 3, and is attached, at the other end, to an upper portion of the partition wall 11 so as to urge the partition wall 11 in the direction of the arrow f at all times. A toner regulating blade 12 made of ribbon steel and having a thickness of 0.1 mm is attached to a lower portion of the partition wall 11 so as to be brought into pressing contact with the surface of the toner supply roller 7 by a force of about 1.0 g/mm, acting against the rotation (arrow c) of the toner supply roller 7, by the tension spring 13.

Furthermore, below the toner supply roller 7, a film 14 for preventing return of the toner is attached to the casing 31 so as to be brought into pressing contact with the toner supply roller 7 in a direction extending generally along the rotational direction (arrow c) of the toner supply roller 7.

The toner reservoir 15 is bounded, in a rear portion of the developing tank 3, by the partition wall 11, the toner regulating blade 12, the toner supply roller 7 and the film 14. In the toner reservoir 15, a stirring rod 16 and a stirring vane 17 disposed adjacent to the toner supply roller 7 are rotatably mounted so as to be rotated in the directions of the arrows d and e, respectively.

Hereinbelow, operation of the developing device 2 having the above-described arrangement is described. Initially, starter, which is a mixture of magnetic carrier and insulating toner, is loaded into the hollow 10 disposed above the developing sleeve 4 and the toner supply roller 7, while the insulating toner is loaded into the toner reservoir 15. At this time, only the magnetic carrier can also be loaded into the hollow 10 instead of the starter referred to above. Thus, an electrostatic latent image can be developed into a visible image by the developing device 2.

When a print switch (not shown) is turned on in this state, the developing sleeve 4, the toner supply roller 7, the stirring rod 16 and the stirring vane 17 are rotated in the directions of the arrows b, c, d and e, respectively.

During the above-described operation of the developing device 2, the toner in the bottom portion of the toner reservoir 15 flows towards the toner supply roller 7 under the stirring action of the stirring rod 16. Then, the toner, which has been crushed into fine particles by the stirring vane 17, is deposited in the minute recesses 71 on the toner supply roller 7 in a toner replenishment region Z. Subsequently, the toner, which has been supplied to the toner supply roller 7, is transported in the direction of the arrow c. Thus, surplus toner is scraped off from the toner supply roller 7 by the toner regulating blade 12 and the toner is electrically charged preliminarily through its contact with the toner regulating blade 12 so as to proceed to a toner supply region Y where the toner supply roller 7 and the developing sleeve 4 confront each other.

In the toner supply region Y, the developer on the developing sleeve 4 is transported in an erect state along the lines of magnetic force generated from the magnetic pole N3. With this magnetic brush, the toner on the toner supply roller 7 is scraped off therefrom. In addition, the toner is electrostatically attracted by the carrier on the developing sleeve 4 and thus, is supplied from the toner supply roller 7 to the developing sleeve 4.

At the same time, on the basis of a difference (Vss-Vb) between the bias voltage Vss of the toner supply roller 7 and the bias voltage Vb of the developing sleeve 4, the toner on the developing sleeve 4 is collected electrostatically by the toner supply roller 7 such that the concentration of the toner in the developer on the developing sleeve 4 is maintained constant.

Thus, in the toner supply region Y, the toner is delivered properly between the developing sleeve 4 and the toner supply roller 7 such that concentration of the toner in the developer on the developing sleeve 4 is maintained at a proper value.

The toner supplied, at one portion of the toner supply region Y confronting the magnetic pole N3, from the toner supply roller 7 to the surface of the developing sleeve 4 is transported, by the rotation of the developing sleeve 4, in the direction of the arrow b together with the developer held on the developing sleeve 4. Then, from the magnetic pole N3 to the magnetic pole S2, the developer is transported in a layered state along the lines of magnetic force. However, the magnetic brush rises relatively radially between the magnetic poles S2 and the weak magnetic pole N2 so as to be transported in sparse amounts between these poles as shown in FIG. 3.

Then, at the front face of the bristle height regulating plate 6, the developer rises. Furthermore, since the magnetic force of the magnetic pole N2 is small, most of the developer and the toner is blocked in front of the bristle height regulating plate 6 and thus, is pushed by the developer transported subsequently so as to readily rise greatly along the bristle height regulating plate 6. Thereafter, a portion of the developer and the toner falls on the developer receiving plate 8 so as to be fed along the developer receiving plate 8 onto the developing sleeve 4. Meanwhile, another portion of the developer and the toner directly falls on the developing sleeve 4 so as to be fed thereto. However, the developer falling down directly on the developing sleeve 4 is diffused so as not to be concentrated because the lines of magnetic force rise. Since the developer is diffused widely over the developing sleeve 4, developer having a nonuniform density is not produced.

Namely, in the hollow 10 in front of the bristle height regulating plate 6, the developer is properly stirred so as to be mixed while forming vortexes so as to be made uniform. Meanwhile, the toner is brought into contact with the carrier so as to be electrically charged, through friction between the toner and the carrier, to a level sufficient for performing development such that the developer and the toner are uniformly supplied to the developing sleeve 4. Meanwhile, between the magnetic pole N2 and the magnetic pole S1 and between the magnetic pole N2 and the magnetic pole S2, since the lines of magnetic force are distributed in a layered state, although the magnetic force is small, the developer is positively transported on the developing sleeve 4. Since the magnetic force of the developer striking against the bristle height regulating plate 6 is small, a force exerted thereby on the bristle height regulating plate 6 is minimal. In other words, a driving force exerted on the developing sleeve 4 by the bristle height regulating plate 6 is also minimal.

Meanwhile, the developer disposed on one portion of the developing sleeve 4 confronting the bristle height regulating plate 6 rises in a sparse state. Therefore, even if a slight error is produced when adjusting the gap between the bristle height regulating plate 6 and the developing sleeve 4, an undesirable phenomenon in which the amount of the developer transported per unit time varies greatly, does not occur.

A portion of the developer thus sufficiently stirred so as to be mixed passes through the gap between the bristle height regulating plate 6 and the developing sleeve 4 so as to form a magnetic brush. This magnetic brush rubs against the surface of the photosensitive drum 1 at the developing region X so as to develop an electrostatic latent image on the surface of the photosensitive drum 1 into a visible image.

After passing through the developing region X, the developer remaining on the outer peripheral surface of the developing sleeve 4 is successively transported in the direction of the arrow b by the rotation of the developing sleeve 4 and then, reaches the toner supply region Y where the developing sleeve 4 and the toner supply roller 7 confront each other. At this time, new toner is supplied to the developing sleeve 4 by the toner supply roller 7 and surplus toner is collected by the toner supply roller 7 as described above. Subsequently, when the developing sleeve 4 reaches the hollow 10 again, the developer stirred sufficiently so as to be mixed is replenished uniformly to the surface of the developing sleeve 4 so as to eliminate a consumption pattern of the toner consumed in the previous development.

On the other hand, the toner collected by the toner supply roller 7 is deposited in the minute recesses 71 and then, proceeds between the toner supply roller 7 and the film 14 so as to enter the toner reservoir 15.

In this embodiment, although the magnetic force of the weak magnetic pole N2 is set at 200 G, experiments conducted by the present inventors have revealed that the same results as those of this embodiment can be obtained by selecting the magnetic force of the magnetic pole to be within a range of about 0 to 400 G.

Figure 5:
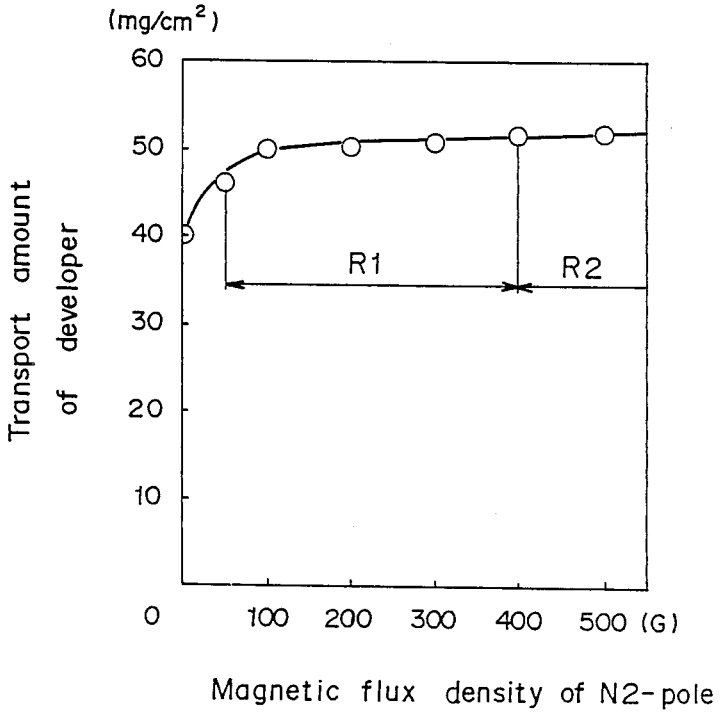
FIG. 5 is a graph showing the relation between magnetic flux density of a weak magnetic pole and transport the amount of developer transported in the developing device of FIG. 1.

FIG. 5 is a graph illustrating variations in the amount of the developer transported in response to changes in the magnetic flux density of the magnetic pole N2 in the developing device 2. In this experiment, the amount of the developer transported refers to the amount of the developer transported per unit area at a downstream side of and in the vicinity of the bristle height regulating plate 6. As will be seen from FIG. 5, even if the magnetic force of the magnetic pole N2 is reduced, the developer is transported sufficiently. If the magnetic force of the magnetic pole N2 is less than 100 G, the amount of the developer transported drops slightly but an amount of the developer which is not problematical for practical use is transported because the developing sleeve 4 is formed, on the surface, with the minute uneven portions.

Next, stirring of the developer will be described. When the magnetic flux density of the magnetic pole N2 is 500 G (range R2) in this experiment, a striped pattern appears on the copied image. On the contrary, as the magnetic pole N2 is selected to be weaker, a better copied image can be obtained.

Namely, in the developing device 2 of the above-described embodiment, when the magnetic flux density of the magnetic pole N2 ranges from 100 to 400 G (range R1), both transport and stirring of the developer can be performed properly.

In the same manner as they conducted the above-described experiment, the present inventors conducted another experiment in which not only the magnetic flux density of the magnetic pole N2 but those of the magnetic poles S1 and S2 were changed. This experiment showed that the following conditions set forth in Table 1 below achieve good results.

TABLE 1

| Sl, S2 (G) | N2 (G) |
|---|---|
| 300–500 | 50–200 |
| 500–700 | 100–300 |
| 700–1,500 | 120–600 |

From Table 1, it can be concluded that if the magnetic flux density of the magnetic pole N2 is set at 1/6 to 2/5 of those of the magnetic poles S1 and S2, desirable results are achieved.

Meanwhile, if the magnetic pole S1 is larger, in size, than the magnetic pole S2 in the case in which the magnetic force of the magnetic pole N2 is rather small, the magnetic flux of the magnetic pole N2 is directed towards the magnetic pole S1, so that the magnetic flux between the magnetic poles S2 and N2 is reduced and thus, transport of the developer is likely to be adversely affected by gravity. Therefore, it is desirable that size of the magnetic pole S1 be equal to or smaller than that of the magnetic pole S2.

Furthermore, in this embodiment, the weak magnetic pole N2 is disposed at the upper end portion of the magnetic roller 5 such that the distal end portion of the bristle height regulating plate 6 is disposed in the vicinity of the magnetic pole N2. However, the weak magnetic pole N2 can also be offset slightly upstream or downstream from the upper end portion of the magnetic roller 5 and with the distal end portion of the bristle height regulating plate 6 confronting the developing sleeve 4 at an upstream side or a downstream side of the weak magnetic pole N2 as far as the distal end portion of the bristle height regulating plate 6 is disposed in the vicinity of the weak magnetic pole N2.

However, from a standpoint of the stirring of the developer for effective mixing thereof, it is desirable that the bristle height regulating plate 6 be disposed such that the following equation is satisfied. The character $\beta$ denotes an angle formed between the magnetic pole N2 and the bristle height regulating plate 6 and character $\alpha$ denotes an angle formed between the magnetic pole N2 and the magnetic pole S2 as shown in FIG. 3.

$$\beta < (\tfrac{2}{3})\alpha$$

As will be seen from the foregoing description in the developing device of the present invention, a weak magnetic pole is employed as the upper one of the magnetic poles of a plurality of the magnets incorporated in the developing sleeve and strong magnetic poles are disposed at opposite sides of the weak magnetic pole and the distal end portion of the bristle height regulating member confronts the developing sleeve in the vicinity of the weak magnetic pole.

Accordingly, at an upstream side of the bristle height regulating member, the developer is transported in a radially erect state to some extent while being magnetically weakly attracted on the surface of the developing sleeve. Therefore, when the developer strikes against the bristle height regulating member, the developer rises sharply along a warped path so as to be stirred for mixing thereof while being properly diffused. In addition, since the developer falls over a wide area of the developing sleeve, an undesirable phenomenon in which that a striped pattern of the developer of high concentration is formed on the developing sleeve does not occur, so that the developer having a uniform concentration can be stably supplied for development at all times. As a result, the copied image is clear and excellent reproducibility and high quality copies can be obtained.

Especially in the developing device in which the two-component developer composed of the magnetic carrier and the insulating toner is adjusted on the developing sleeve, it becomes possible to effectively prepare the toner to a state suitable for development in a limited space and in a short time period.

Meanwhile, since the magnetic force of the developer striking against the bristle height regulating member is small, a load applied to the driving source for the developing sleeve can be reduced.

Furthermore, the developer rises radially in the vicinity of the weak magnetic pole so as to be in a sparse state. Thus, even if the gap between the bristle height regulating member and the developing sleeve is changed slightly, the amount of the developer transported to the developing region does not vary greatly, thereby resulting in simple and easy adjustment of the gap.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A developing device for developing an electrostatic latent image formed on a support member, said device comprising:

a rotatable developing sleeve disposed adjacent to the support member so as to define a developing region therebetween, said developing sleeve for rotating about an axis thereof to transport developer to the support member at said developing region during rotation of said developing sleeve;

supply means for supplying developer to said developing sleeve;

a bristle height regulating member confronting an upper portion of said developing sleeve for limiting the amount of developer transported by said developing sleeve to the support member; and a plurality of stationary magnets within said developing sleeve having respective magnetic poles each of which confronts said developing sleeve and extends axially with respect to said developing sleeve, said magnetic poles spaced from one another in a direction extending circumferentially around said developing sleeve, said magnetic poles including a first magnetic pole located adjacent said upper portion of said developing sleeve, and second and third magnetic poles between which said first magnetic pole is interposed, said first magnetic pole having a predetermined polarity, said second and said third magnetic poles each having a magnetic polarity opposite to said predetermined magnetic polarity, and said second and said third magnetic poles each having a maximum magnetic field component in a radial direction of said developing sleeve that is greater than the maximum magnetic field component in the radial direction of said first magnetic pole.

2. A developing device as claimed in claim 1, wherein said maximum magnetic field component of said first magnetic pole is between 1/6 and 2/5 of each of the maximum magnetic field components of said second and said third magnetic fields, respectively.

3. A developing device as claimed in claim 1, wherein the maximum magnetic field component of said first magnetic pole is at most 400 Gauss.

4. A developing device as claimed in claim 2, wherein the maximum magnetic field component of said first magnetic pole is at most 400 Gauss.

5. A developing device as claimed in claim 1, wherein said second, first and third magnetic poles are sequentially arranged in the foregoing order in the direction in which said developing sleeve is rotatable and are positioned from one another such that $$\beta<(\tfrac{2}{3})\alpha$$

$\beta$ denoting an angle in radians defined between said first magnetic pole and said bristle height regulating member with respect to said axis of said developing sleeve, and $\alpha$ denoting an angle in radians defined between said first and said second magnetic poles with respect to said axis of said developing sleeve.

6. A developing device as claimed in claim 2, wherein said second, first and third magnetic poles are sequentially arranged in the foregoing order in the direction in which said developing sleeve is rotatable and are positioned from one another such that $$\beta<(\tfrac{2}{3})\alpha$$

$\beta$ denoting an angle in radians defined between said first magnetic pole and said bristle height regulating member with respect to said axis of said developing sleeve, and $\alpha$ denoting an angle in radians defined between said first and said second magnetic poles with respect to said axis of said developing sleeve.

7. A developing device as claimed in claim 3, wherein said second, first and third magnetic poles are sequentially arranged in the foregoing order in the direction in which said developing sleeve is rotatable and are postioned from one another such that $$\oplus<(\tfrac{2}{3})\alpha$$

$\beta$ denoting an angle in radians defined between said first magnetic pole and said bristle height regulating member with respect to said axis of said developing sleeve, and $\alpha$ denoting an angle in radians defined between said first and said second magnetic poles with respect to said axis of said developing sleeve.

8. A developing device as claimed in claim 4, wherein said second, first and third magnetic poles are sequentially arranged in the foregoing order in the direction in which said developing sleeve is rotatable and are positioned from one another such that $$\beta<(\tfrac{2}{3})\alpha$$

$\beta$ denoting an angle in radians defined between said first magnetic pole and said bristle height regulating member with respect to said axis of said developing sleeve, and $\alpha$ denoting an angle in radians defined between said first and said second magnetic poles with respect to said axis of said developing sleeve.

* * * * *